US005467858A

United States Patent [19]

Kovens et al.

[11] Patent Number: 5,467,858

[45] Date of Patent: Nov. 21, 1995

[54] COIN BOX INSERT FOR BULK VENDING MACHINES

[75] Inventors: Steven A. Kovens, Reistertown; Michael T. Doyle, Columbia, both of Md.

[73] Assignee: Parkway Machine Corporation, Timonium, Md.

[21] Appl. No.: 98,051

[22] Filed: Jul. 26, 1993

[51] Int. Cl.[6] ..... G07F 9/06

[52] U.S. Cl. ..... 194/350; 232/15

[58] Field of Search ..... 194/236, 255, 194/350; 232/15, 16; 221/155, 203, 265; 312/212; 220/475, DIG. 13

[56] References Cited

U.S. PATENT DOCUMENTS

| | | | |
|---|---|---|---|
| 2,880,906 | 4/1959 | Probasco | 221/203 |
| 3,018,148 | 9/1961 | Probasco . | |
| 3,390,753 | 7/1968 | Bolen et al. | 194/350 |
| 3,804,294 | 4/1974 | Householder | 221/265 X |
| 5,044,483 | 9/1991 | Stefan | 194/350 |
| 5,131,519 | 1/1962 | Stefan | 194/350 |

FOREIGN PATENT DOCUMENTS

| | | | |
|---|---|---|---|
| 2230425 | 10/1990 | United Kingdom | 220/475 |

*Primary Examiner*—F. J. Bartuska

*Attorney, Agent, or Firm*—Beveridge, DeGrandi, Weilacher & Young

[57] ABSTRACT

A convertible coin box for a coin-operated bulk vending machine has a nesting coin retaining box established by base-conforming side walls and a vertically disposed slot for translating the box relative to the vending machine axial securing shaft.

9 Claims, 2 Drawing Sheets

COIN BOX INSERT FOR BULK VENDING MACHINES

TECHNICAL FIELD

The present invention is directed to a coin box insert for coin-actuated bulk vending machines. More particularly, the invention is directed to a preformed coin box capable of nesting in the base of a coin-actuated bulk vending machine below the coin receiving mechanism thereof for the purpose of facilitating coin collection by sequestering coins passed through the mechanism.

BACKGROUND OF THE INVENTION

For identification, as used herein coin-operated bulk vending machine indicates the conventional crank-handle operated dispensing machines commonly found on racks in the front of large retail outlets such as grocery stores. Conventional coin-operated bulk vending machines often feature a coin receipt mechanism secured within a box-like base where coins introduced into the mechanism are discharged into the base. Thus, in order to collect coins gathered on the base floor, in the course of routine maintenance, service personnel must disassemble the machine, collect the coins from the base, and re-assemble the machine. Collecting the coins most commonly entails sweeping the floor with the hand or tipping the base causing the coins to spill out of the base.

Typically coin operated bulk vending machines include a metal or metal/plastic housing defined by a base which supports a merchandise container (globe) generally set on the base which is sealed with a locking lid. A merchandise wheel is disposed at the interface between the top opening in the base and the bottom of the merchandise container. The wheel is divided into a plurality of compartments for selecting a discrete quantity of merchandise. As the wheel is turned, each compartment rotates and communicates the merchandise from the merchandise container to a merchandise chute in the base which is ultimately dispensed upon operation of said machine. The merchandise dispensing chute communicates the discrete quantity of merchandise from the wheel compartment to a merchandise chute opening disposed in a wall of the base.

The base includes a four sided case with an aperture adapted to lockably retain a coin receiving mechanism, and the merchandise chute opening, generally incorporating a chute cover and located in the wall below the coin receiving mechanism.

The coin receiving mechanism is crank operated and operably connected to the merchandise wheel to rotate the wheel when the coinage of appropriate denomination is introduced into and discriminated by the coin receiving mechanism. Upon rotation, merchandise originally gravity fed into the merchandise wheel from the merchandise container, is rotated to the opening of the merchandise chute and falls into that passage for dispensing through the merchandise chute opening.

The entire assembly is secured together with a metal shaft threadably secured to a centrally disposed threaded lug located on the base floor passing through a centrally located feedthrough in the merchandise wheel, and to the top of the merchandise container for threadable connection top a rotatable barrel lock projecting through a lid corresponding to the container top.

In the bulk vending field, attempts have been made to provide special coin drawers and the like. One such example is found in U.S. Pat. No. 3,390,753. However, the additional costs and mechanical complexity of such devices render them undesirable in the bulk vending field where mechanical simplicity and minimum maintenance are critical. Accordingly, such devices are generally found to be impractical and not widely used.

Other coin intensive, albeit unrelated, disciplines, such as the gambling industry, provide specialized coin collection box structures. One such example is a slot machine coin box chute combined with a retractable coin drawer depicted in Stefan U.S. Pat. No. 5,044,483. The additional structural complexity and greater space requirements make such concepts generally inapplicable to bulk vending machines.

Turning specifically to the bulk vending field, typically, coin operated bulk vending machines incorporate an axial shaft lockdown mechanism. The shaft extends from the base floor to the lid, i.e., completely through the machine. Thus, the coins fall from the coin receiving mechanism to the base floor around the shaft.

It has been reported that nesting plastic liners have been used in conjunction with certain bulk vending machines in the past. In order for a liner to conform to the base, it featured a hole through which the axial shaft passed. To collect the coins collected in the liner at the base of the machine, the machine was disassembled by unlocking the barrel lock from the axial shaft, removing the merchandise container from the base and translating the coin laden liner along the entire axial shaft length. Once free of the shaft the operator dumped the coins from the liner into a coin bag or other receptacle. Thus, the presence of a liner not only did not shorten the long-practiced coin collection methodology but actually complicated coin removal.

SUMMARY OF THE INVENTION

Thus, it is an object of the present invention to overcome the problems in the prior art and provide the advantages of an insertable/removable coin box for coin operated bulk vending machines.

Other objects of this invention are to provide a coin box having a configuration adapted for nesting within the base of a machine and having the capability for being horizontally slidably removable from the base.

Still further objects of this invention are to provide a unitary molded coin box/tray formed from molded thermoplastic which possesses sufficient strength to hold a substantial number of coins and retain its structural integrity while being translated relative to the base of the coin-operated machine.

Yet another object of this invention is to provide a method for removing a coin containing coin box from a coin operated bulk vending machine.

These and other objects are satisfied by a coin insert box, comprising: side walls and a floor dimensioned to nest in the base of a coin-operated vending machine and defining a receptacle to receive and retain coinage; and a slotted member formed in at least one of said side walls.

Other objects of the invention are satisfied by a method of collecting coins in a slotted coin box insert and removing the coins from a coin operated vending machine where the machine includes a lid with a lock; a merchandise container; a case body with four side walls, a coin receipt mechanism and a top adapted to receive the merchandise container; a base with a floor and a plurality of upwardly projecting (preferably three) side walls of a selected height which define a perimeter corresponding to the interior perimeter of the case body walls; and a shaft capable of attachment to the base and being of a length to extend through the case body and the merchandise container to be lockable with the lid, the method comprising the steps of:

a) unlocking the lid from the shaft;

b) translating the case body and merchandise container upwardly a distance corresponding to the height of the base walls;

c) rotating the case body to a position to permit it to rest on the base walls;

d) removing by sliding the coin box insert from the base through the opening formed between the base and the case body; and e) removing the coins from the coin box insert.

Once the coins are removed the method contemplates reassembly by the following steps:restoring the coin box insert to nest in the base by sliding the coin box insert through the opening formed between the case body and the base so that the shaft translates through the slot; rotating the case body to a position where the case body walls and the base walls are aligned so as to be in substantial registry; sliding the case downwardly over the base walls; and locking the lid and the shaft together.

Given the following enabling description of the drawings, the inventive coin box insert for coin actuated bulk vending machines the scope of the invention should become evident to a person of ordinary skill in the art.

DETAILED DESCRIPTION OF THE PREFERRED EMBODIMENT

Figure 1:
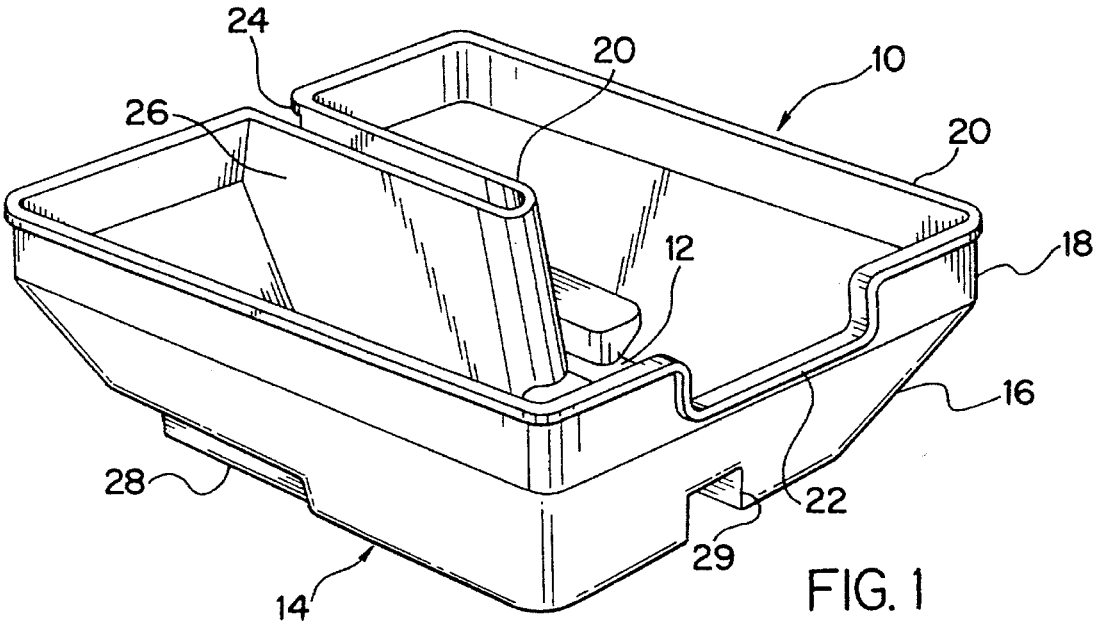
FIG. 1 is a perspective view of an embodiment of a coin box insert according to the invention.

FIGS. 1 and 3–5 depict an embodiment of a coin box insert 10 according to the invention. The depicted embodiment of the coin box insert is particularly suited for use with such well-known coin operated bulk vending machines as the PM Elite, the PN95, manufactured by Applicant, Parkway Machine Corporation and even fits such old machines as the Model 60 supplied by Northwestern Machine Corporation.

In the illustrated embodiment of FIGS. 1 and 3–5, the coin box insert 10 is formed by vacuum thermo-forming from a sheet of rugged molded thermoplastic material such as high impact styrene 100 mil (or thicker) preferably of black or grey color. The box insert 10 features a floor 12 adapted to rest on the floor of a bulk vending machine base and bifurcated side walls 14. The bifurcated side walls 14 comprise flared side wall portions 16, rising a select distance from the floor 12 to perpendicular wall section 18. The perpendicular wall section is topped by lip 20 which extends substantially entirely about the periphery of the upper portion of the box insert 10 so as to abut the internal walls of the bulk vending machine base. Thus, the size of the lip 20 can be altered to correspond to the interior dimensions of the bulk vending machine and to prevent the formation of peripheral gaps large enough for coins to slip through. The lip 20 is generally thicker and more rigid than the remainder of the box body to thereby define a reinforcing bead. Thus, the box 10 nests, without deformation, within the machine base.

A notch 22 is formed in of one of the perpendicular wall sections 18 to accommodate the bulk vending machine merchandise chute communicating with the machine's merchandise container. The size of the notch 22 is governed by the depth of the merchandise chute relative to the height of the box 10. (In certain models where the chute would not intersect the top of the box, there would be no need for the notch.) It is preferred that the edge of the notch 22 be reinforced by the continuation of the lip 20.

Formed in the opposite wall of the notch 22 is a critical feature of the invention; the perpendicular slot 24. The slot 24 extends from the center of the side wall 14 to just beyond the center of the box insert 10. The slot 24 is defined by continuous side wall 26 integrated with the floor 12 and the side wall portions 16 and 18 to form a unitary container defining a sealed bottom. The slot 24 extends the entire depth of the insert box 10 from the floor 12 and the side wall 14 and is topped by lip 20. The width of the slot 24 is slightly more than the diameter of the axial locking shaft of the bulk vending machine, i.e. slightly more than ¼ inch, and is configured so that box insert 10 fits loosely about the shaft but not so loosely so as to permit coins to easily fall through.

The provision of slot 24 allows an operator to move the box insert 10 laterally/transversely to translate about the axial shaft without the need for moving the box insert 10 longitudinally along the length of the shaft.

To facilitate such translation, the floor 12 of the box insert 10 also includes a series of elongated kerfs 28 and 29 extending in a direction generally parallel to the slot 24 (the direction of translation). The kerfs 28 and 29 permit the box insert 10 unimpeded transverse translation over the over screws, lugs or other projections extending above the bulk vending machine base floor.

Figure 2:
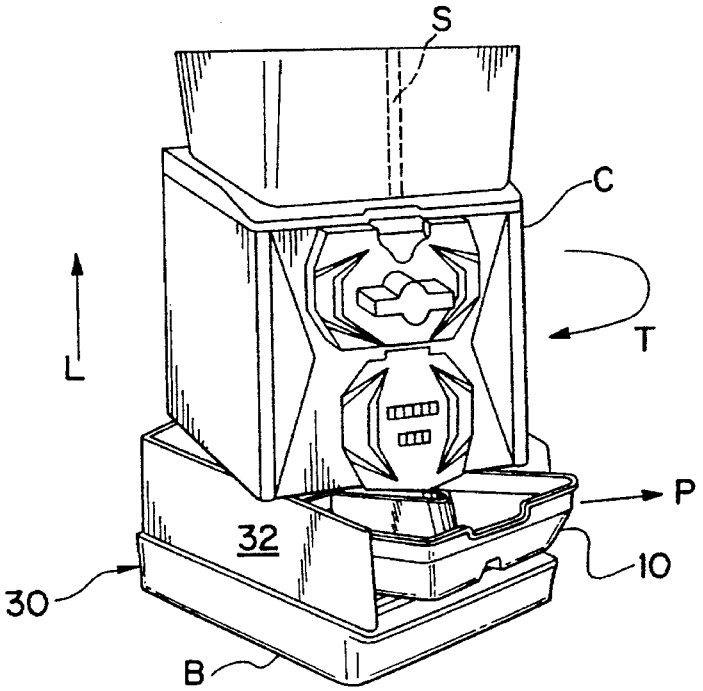
FIG. 2 is a perspective view of the coin box insert embodiment of FIG. 1 being removed from a coin operated bulk vending machine in accordance with this invention.
Figure 3:
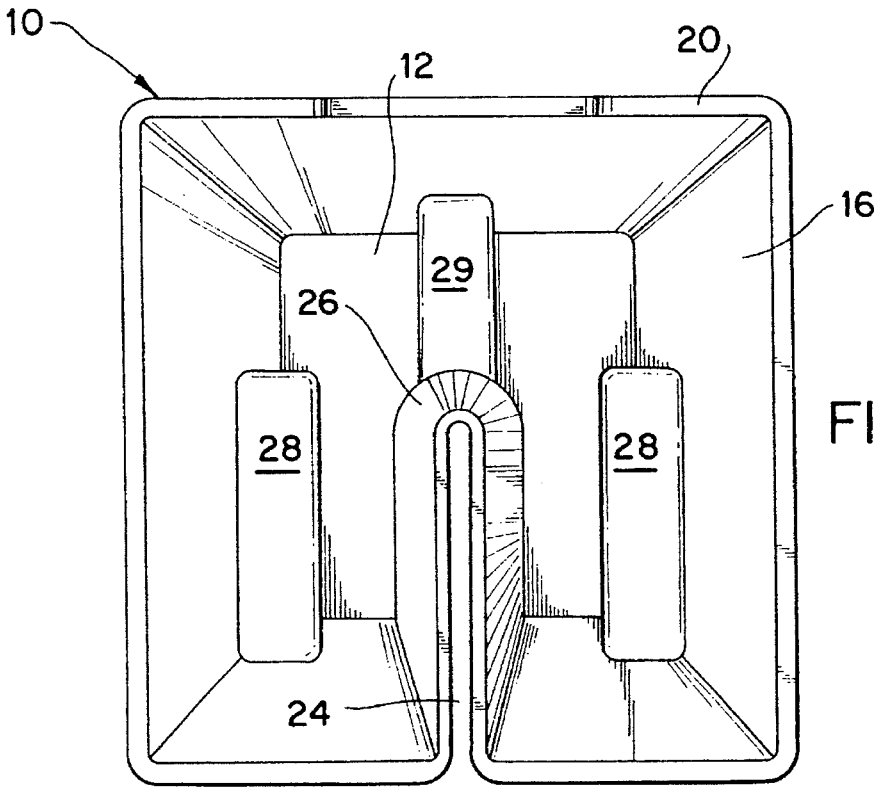
FIG. 3 is a top view of the embodiment of FIG. 1.
Figure 4:
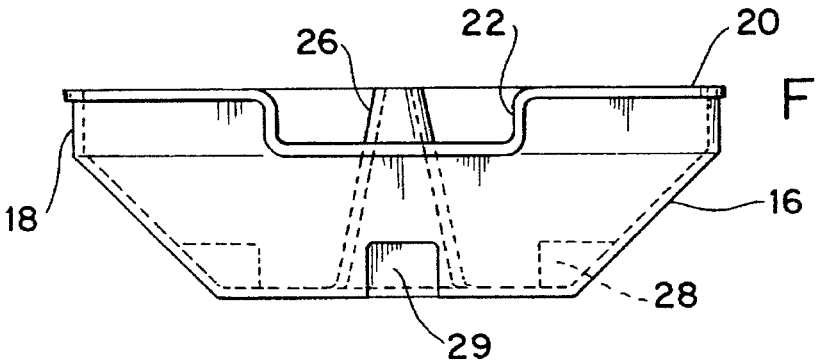
FIG. 4 is a front view of the embodiment of FIG. 1 with ghost lines for certain features.
Figure 5:
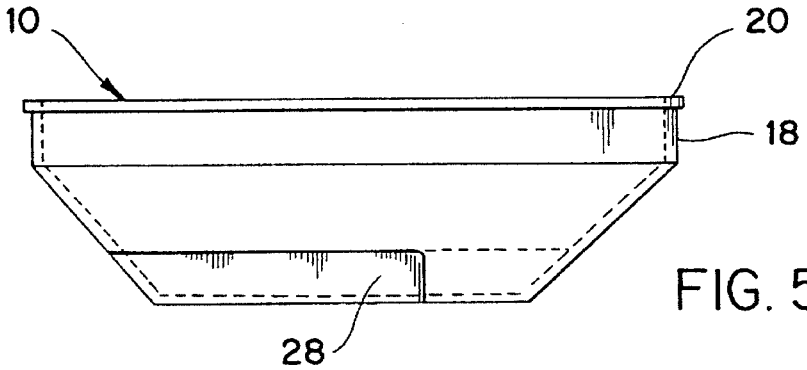
FIG. 5 is a side view of the embodiment of FIG. 1 with ghost lines for certain features.

Referring now to FIG. 2, the operation or methodology for use of the inventive coin box insert is described. More particularly, FIG. 2 pictorially represents the removal operation of the box insert 10 from a coin operated bulk vending machine 30. After unlocking the lid from the axial shaft (S), the case (C) is lifted from the base (B) in the direction of arrow (L). When lifted a height sufficient to clear the interior machine base retaining walls 32, the case (C) is twisted about the shaft in the direction of arrow (T) and then rested on the top of the interior base walls 32. The operator then reaches into the base and pulls box insert 10 in the direction of arrow (P) through the gap formed in the front of the machine between the case (C) and the base (B). After dumping the coins from the box insert 10, the operator reinserts the box 10 through the front of machine 30 until it nests on the base floor. The operator then twists the case (C) until it is aligned with the base (B) and slides the case downwardly onto the base. The bulk vending machine 30 can then be secured by locking the lid onto the axial shaft (S). Other variations include a box featuring a flat U-shaped floor with substantially perpendicular walls. Another variation contemplates a rounded trough-type box defined by a continuously curved wall. Both of these foregoing variations would incorporate the appropriate side wall structure to define the requisite slot member. It may also prove advantageous for manipulation to provide a series of small holes drilled or injection molded into the box, sized to permit insertion of a finger but to prevent passage of a coin.

As indicated above, the specific dimensions of the box such as the height and placement of the respective structural features will be governed by the specific machine or machine type for which the box is intended. For example, the notch may be formed on one side or the other to correspond to the position of the merchandise chute of the bulk vending machine.

Given the foregoing, variations and modifications to the invention should now be apparent to a person having ordinary skill in the art. These variations and modifications are intended to fall within the scope and spirit of the invention as defined by the following claims.

We claim:

1. A coin insert box, comprising:

side walls and a floor dimensioned to nest in the base of a coin-operated vending machine, the base defining a base floor and defining a receptacle to receive and retain coinage; and a slotted member formed in at least one of said side walls which has a length extending over the center of the receptacle;

where said receptacle has a U-shaped floor defining a base and two legs lying generally in a plane, a peripheral upper edge spaced above said floor and dimensioned to substantially conform to the internal dimensions of the coin operated bulk vending machine base, side walls flaring and rising at an angle, at least in part, from said floor to said peripheral edge, and a continuous lip formed along said receptacle peripheral upper edge where said receptacle covers substantially the entire base floor and where said receptacle can be moved transversely relative to the machine base.

2. A coin box for a coin operated bulk vending machine having an axial locking shaft, comprising:

a receptacle of selected depth for retaining coins introduced therein, said receptacle periphery being dimensioned to correspond to the transverse cross-sectional dimensions of the inner walls of the bulk vending machine and the floor of the bulk vending machine and where said receptacle is adapted to nest therein;

a slotted member formed in said receptacle extending from the periphery to the center thereof, said slotted member defining a slot having a width substantially corresponding to the cross-sectional dimension of the axial locking shaft;

where said receptacle has an angle, U-shaped floor dimensioned to substantially overlie the bulk vending machine floor and comprising a generally planar floor defining a base and two legs, slanted side walls rising at an angle from said floor, a perpendicular wall section rising substantially perpendicularly relative to the U-shaped floor, and a continuous peripheral lip defined along the upper periphery of said receptacle and about said slotted member, and where said receptacle can be removed from said coin operated bulk vending machine transversely relative to the axial shaft.

3. A coin box according to claim 2 where said receptacle is vacuum molded thermoplastic.

4. A coin box according to claim 2 where said floor includes at least one elongated recess for accommodating translation of said receptacle over features projecting from the coin machine base.

5. A container having a U-shaped floor defining a base and two legs and a generally planar area, a peripheral upper edge spaced at a select distance above said floor and dimensioned to substantially conform to the internal dimensions of the base of a coin operated bulk vending machine, bifurcated walls including a flaring first section rising at an angle from the floor to a point below the peripheral edge, a second wall section rising substantially perpendicular to the floor to the peripheral edge, an elongated transverse slot to accommodate a perpendicularly projecting shaft from the machine said slot extending from the side wall to beyond the center of the container for accommodating transverse translation of said container relative to said base, said slot forming a discontinuity along one side of the periphery of said container, said slot being defined by first and second wall sections, where said container can be transversely translated uninterruptedly relative to base floor of the vending machine.

6. A coin box according to claim 5 where said peripheral edge defines a reinforcing bead defining a ledge which also extends about the perimeter of the slot.

7. A coin operated bulk vending machine, comprising:

a) a base, the base defining a base floor;

b) a case set on said base in an interlocking manner;

c) a merchandise container, set on and above said base;

d) a merchandise wheel disposed between said base and said container for selecting a discrete quantity of merchandise to be dispensed upon operation of said machine;

e) a merchandise dispensing passage for communicating said discrete quantity of merchandise to an opening disposed in said base;

f) a coin receiving mechanism disposed on said base and operably connected to said merchandise wheel to rotate said wheel to dispense merchandise into said passage; and g) a coin insert box nested in case and resting on said base, said coin insert box including side walls and a floor dimensionally conforming to and overlying the base, said box defining a receptacle to receive and retain coinage; and a slotted member formed in at least one of said side walls which has a length extending over the center of the receptacle;

where said receptacle has a U-shaped floor defining a base and two legs lying generally in a plane, a peripheral upper edge spaced above said floor and dimensioned to substantially conform to the internal dimensions of the coin operated bulk vending machine base, side walls flaring and rising at an angle, at least in part, from said floor to said peripheral edge, and a continuous lip formed along said receptacle peripheral upper edge where said receptacle covers substantially the entire base floor and where said receptacle can be moved transversely relative to the machine base.

8. A method of sequestering coins in a slotted coin box insert and removing the coins from a coin operated vending machine where the machine includes a lid with a lock; a merchandise container; a case body with four side walls, a coin receipt mechanism and a top adapted to receive the merchandise container; a base with a floor and a plurality of upwardly projecting side walls of a selected height which define a perimeter corresponding to the interior perimeter of the case body walls where the case body and the base are separable to form an opening; and a shaft capable of attachment to the base and being of a length to extend through the case body and the merchandise container to be lockable with the lid, the method comprising the steps of:

a) unlocking the lid from the shaft;

b) translating the case body and merchandise container upwardly a distance corresponding to the height of the base walls;

c) rotating the case body to a position to permit it to rest on the base walls;

d) removing by sliding the coin box insert from the base through the opening formed between the base and the case body; and e) removing the coins from the coin box insert.

9. The method of claim 8 further including the steps of:

restoring the coin box insert to nest in the base by sliding the coin box insert through the opening formed between the case body and the base so that the shaft translates through the slot;

rotating the case body to a position where the case body walls and the base walls are aligned so as to be in substantial registry;

sliding the case downwardly over the base walls; and locking the lid and the shaft together.

* * * * *